US008689723B2

(12) United States Patent
Chae et al.

(10) Patent No.: US 8,689,723 B2
(45) Date of Patent: Apr. 8, 2014

(54) DISK FOR HORN OF VEHICLE

(75) Inventors: Ki Sang Chae, Gyeonggi-do (KR); Jong Suh Park, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 71 days.

(21) Appl. No.: 13/424,840

(22) Filed: Mar. 20, 2012

(65) Prior Publication Data

US 2013/0145982 A1 Jun. 13, 2013

(30) Foreign Application Priority Data

Dec. 12, 2011 (KR) ..... 10-2011-0132541

(51) Int. Cl.

| | |
|---|---|
| ***G10K 9/20*** | (2006.01) |
| ***G10K 9/18*** | (2006.01) |
| *G08B 3/00* | (2006.01) |

(52) U.S. Cl.
USPC ..... 116/142 R; 340/388.1

(58) Field of Classification Search
USPC ..... 116/142 R
See application file for complete search history.

(56) References Cited

U.S. PATENT DOCUMENTS

2005/0179523 A1* 8/2005 Chiang ..... 340/388.1

FOREIGN PATENT DOCUMENTS

| | | |
|---|---|---|
| JP | 11-143475 A | 5/1999 |
| KR | 10-1999-0035167 | 5/1999 |
| KR | 10-0346555 | 7/2001 |
| KR | 10-2011-0089013 A | 8/2011 |

OTHER PUBLICATIONS

English Translation of KR 10-2011-0089013 (Receiver Module and Portable Terminal Having the Same to Hui-Su Kim).*

* cited by examiner

*Primary Examiner* — Daniel S Larkin
*Assistant Examiner* — Irving A Campbell
(74) *Attorney, Agent, or Firm* — Edwards Wildman Palmer LLP; Peter F. Corless

(57) ABSTRACT

Discloses is a disk for a horn of a vehicle. The disk of the horn has a shape in which the whole region of the disk is divided into a plurality of regions having different vibration characteristics and has a structure in which the plurality of regions are disposed along a circumferential direction of the disk.

5 Claims, 5 Drawing Sheets

DISK FOR HORN OF VEHICLE

CROSS-REFERENCE TO RELATED APPLICATION

This application claims under 35 U.S.C. §119(a) the benefit of Korean Patent Application No. 10-2011-0132541 filed Dec. 12, 2011, the entire contents of which are incorporated herein by reference.

BACKGROUND (a) Technical Field

The present invention relates to a disk of a horn for a vehicle. More particularly, it relates to a disk of a horn for a vehicle, which can generate a sound of various frequency components in a single disk-type horn and can improve the tone color of the horn in quality.

(b) Background Art

Generally, vehicles are equipped with horns that generate sounds by manipulation of a driver during an emergency situation to warn, e.g., walkers or other vehicles.

Examples of horns for vehicles include disk-type horns and shell-type horns. Disk-type horns include a diaphragm, a disk, and an electromagnet for vibrating the diaphragm and the disk. Also, a disk-type horn includes a contact for intermitting a current flowing into an electromagnet coil in linkage with the diaphragm. In disk-type horns, a sound is mainly generated by the vibration of a disk. Disk-type horns may be divided into a single disk type, which utilizes a single disk, and a multi-disk type, which utilizes a plurality of disks.

Single disk-type horns are disclosed in Korean Patent No. 10-0757249 and Korean Patent Application Publication No. 10-2010-0093508, and a multi-disk type horn is disclosed in Korean Patent No. 10-0391317, these applications are hereby incorporated by reference in their entirety.

In a shell-type horn, a horn having a shell shape is covered on a membrane to enhance low frequency components of a sound. The shell-type horn is configured to generate a sound via vibration of the membrane and sound amplification of the shell.

FIG. 1 illustrates a typical disk-type horn. Hereinafter, a horn 1 with a single disk will be described in detail with reference to FIG. 1. As shown in FIG. 1, the concavity 11*a* is disposed at the central portion of a main body 11, and a pole 12 protrudes in the concavity 11*a*. The pole 12 is wound with a coil 13. Also, a diaphragm 14 is coupled along the outer edge of the main body 11, and a disk 15 is coupled to an armature 16 to be disposed over the diaphragm 14. The armature 16 is disposed over the pole 12.

A stand 17 and a plate spring 18 are coupled to the main body 11 at one side thereof, and extend toward the other side thereof to form a contact 19. The positive terminal of a battery B is electrically connected to the stand, and a grounded operation switch HS is electrically connected to the plate spring 18. The disk 15, the diaphragm 14, and the armature 16 constitute one vibrator. When the vibrator rapidly vibrates, a sound is generated. However, the sound generated by single disk type horns is relatively sharp and the tone color is poor because the main frequency components (i.e., resonant frequency) of the sound are located near about 3 kHz. The audible frequency component ranges from about 20 Hz to about 20 kHz. Particularly, the most sensitive frequency component to human's ear ranges from about 2 kHz to about 5 kHz, and is thus, sharply perceived.

On the other hand, since multi-disk type horns have a plurality of disks, a harmonious sound having various frequency components can be generated. In this case, discomfort caused by a monotonous sound can be somewhat reduced, but the weight and the manufacturing cost of this type of horn can increase due to the addition of disks compared to single disk-type horns.

Also, shell-type horns can generate sounds having various frequency components of about 2 kHz or less, but the sound powers of shell-type horns are not enough to hear clearly. Therefore, usually two shell-type horns have to be equipped in a vehicle in order to comply with the sound pressure regulations. Accordingly, the installation cost can increase compared to disk-type horns.

The above information disclosed in this Background section is only for enhancing the understanding of the invention and therefore it may contain information that does not form the prior art that is already known in this country to a person of ordinary skill in the art.

SUMMARY OF THE DISCLOSURE

The present invention provides a disk for a horn for a vehicle, which can generate a sound of various frequency components in a single disk-type horn and can improve the quality of the tone color from the horn.

In one aspect, the present invention provides a disk for a horn of a vehicle, having a shape in which the whole region of the disk is divided into a plurality of regions having different vibration characteristics and having a structure in which the plurality of regions are disposed along a circumferential direction of the disk.

In an exemplary embodiment, the plurality of regions may have different areas that each have the different vibration characteristics. In addition, the whole region of the disk may be divided into a plurality of regions by cut portions longitudinally formed from an outer edge of the disk to a central portion of the disk. The cut portions may be longitudinally formed from the outer edge of the disk to the central portion of the disk along a radial direction of the disk.

Other aspects and exemplary embodiments of the invention are discussed infra.

BRIEF DESCRIPTION OF THE DRAWINGS

The above and other features of the present invention will now be described in detail with reference to certain exemplary embodiments thereof illustrated in the accompanying drawings which are given hereinbelow by way of illustration only, and thus are not limitative of the present invention, and wherein.

Figure 1:
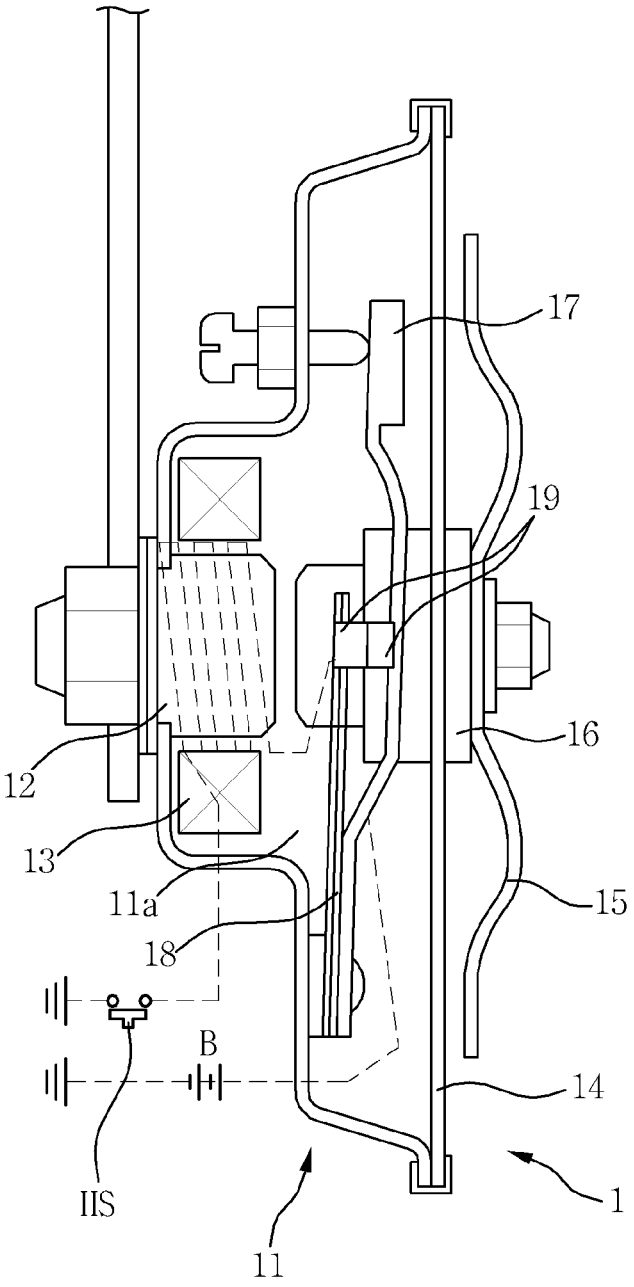
FIG. 1 (PRIOR ART)
FIG. 1 is a view illustrating a typical horn with a single disk.

Reference numerals set forth in the Drawings includes reference to the following elements as further discussed below:

| | |
|---|---|
| 1 | horn |
| 11 | main body |
| 11a | concavity |
| 12 | pole |
| 13 | coil |
| 14 | diaphragm |
| 15 | disk |
| 16 | armature |
| 17 | stand |
| 18 | plate spring |
| 19 | contact |
| 20 | disk |
| 21 | central portion |
| 22 | cut portion |
| 23a, 23b, 23c | divided region |
| A1, A2, A3 | area of divided region |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The above and other features of the invention are discussed infra.

Hereinafter, exemplary embodiments of the present invention will be described in detail with reference to the accompanying drawing.

The present invention relates to a disk used in a horn applying a single disk, and particularly, to a disk used in a horn for a vehicle that generates sounds of various frequency components and can improve the tone color and the quality of horn's sound output.

A disk according to an embodiment of the present invention may have an improved shape so as to have various resonant frequencies during vibration, and thus may generate smoother sound than a typical disk. When a disk according to an embodiment of the present invention is used, the weight and cost can be reduced compared to a typical multi-disk type horn and a shell-type horn, by still utilizing a single disk-type horn.

Figure 2:
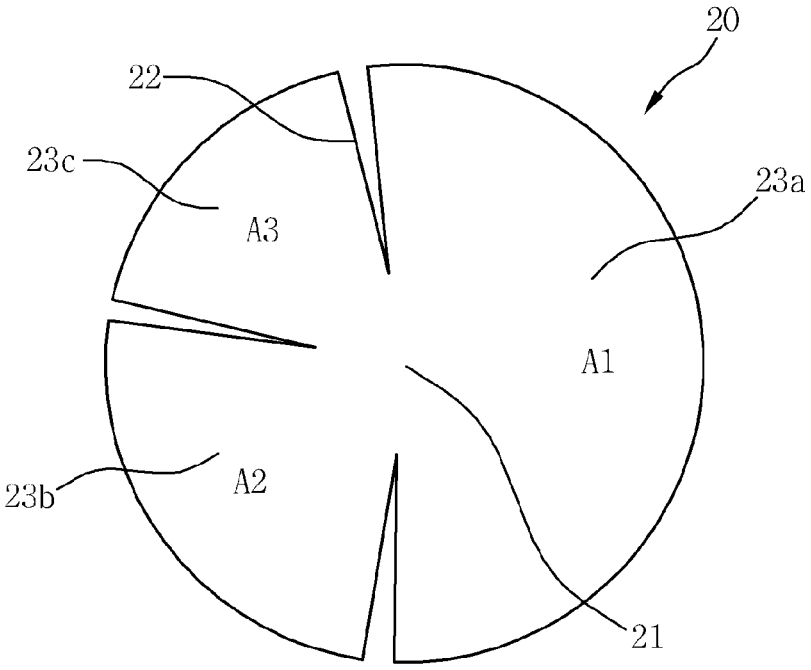
FIG. 2 is a plan view illustrating a disk for a horn according to an embodiment of the present invention.
Figure 3:
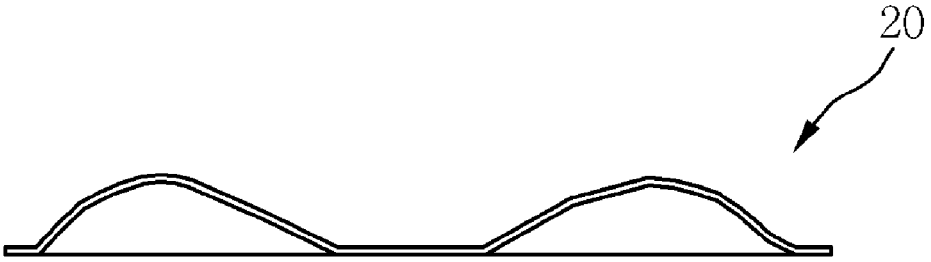
FIG. 3 is a cross-sectional view illustrating a disk for a horn according to an embodiment of the present invention.

FIG. 2 is a plan view illustrating a disk for a horn according to an embodiment of the present invention. FIG. 3 is a cross-sectional view illustrating a disk for a horn according to an embodiment of the present invention. As shown in FIG. 2, a disk 20 may have a petaloid shape that is improved from a typical shape having a continuous circular shape. The disk 20 is divided into a plurality of regions which can be seen when viewed from the top.

Specifically, the disk 20 may be manufactured to have a petaloid shape that is divided into a plurality of regions 23*a* to 23*c* with different vibration characteristics associated with each. The disk 20 may have a divided structure which is divided into the plurality of regions 23*a* to 23*c* by having at least one cut portion 22 that is longitudinally formed from the outer edge to the center 21 thereof. Here, the center 21 may be a portion of a horn (1 of FIG. 1) that is coupled to an armature (16 of FIG. 1). The divided regions 23*a* to 23*c* may be disposed along the circumferential direction of the disk 20.

Furthermore, there may be a plurality of cut portions 22 as shown in FIG. 2 that are each longitudinally formed in the substantially radial direction from the outer edges at different widths. At, however, a location where the cut portion 22 is not formed, the sectional shape of the disk may be substantially identical to that of a well-know disk as shown in FIG. 3.

In order to vary the vibration characteristics of the divided regions, the disk 20 may have a non-uniform division (A1≠A2, A1≠A3, and A2≠A3) structure in which the divided regions 23*a* to 23*c* divided by the cut portions 22 differ in area A1 to A3. The resonant frequency may be varied in each divided region by varying the area of the divided regions 23*a* to 23*c*. Thus, the disk 20 may be formed to have a non-uniform division structure.

In the above structure, when a portion or all of the areas A1 to A3 of the divided regions 23*a* to 23*c* are equal to each other (e.g., A1=A2, A1=A3, and A1=A2=A3), i.e., when the disk 20 is uniformly divided, the divided regions having the same area may have the same frequency components. Accordingly, it is difficult to improve the tone quality and color of a horn. Thus, the disk 20 may for example have three cut portions 22 that are divided into three regions 23*a* to 23*c*, or may have more or fewer cut portions 22 to be divided into two, four, or five regions depending up on the desired sound frequencies. For example, the disk 20 may have two cut portions 22 that divide the disk into two regions (see FIG. 2), or may have four cut portions that divide the disk into four regions (see FIG. 5B)

In addition, the area of the divided regions may be varied to allow the area ratio of the divided regions to be 1:0.5 (two divided regions), 1:0.5:0.25 (three divided regions), or 1:0.8:0.6:0.4:0.2 (five divided regions). Thus, the disk 20 may be modified into various forms varying in the number of cut portions and the divided regions, the area ratio of the divided regions, and the location of the cut portions, and is not limited to the embodiments shown in the accompanying drawings.

A method for manufacturing a disk with such a divided structure may be performed by mechanically processing a typical disk and cutting the disk along division lines. In this case, the mechanical processing for cutting may be performed by laser cutting or water jet cutting.

Advantageously, a disk with a non-uniform division structure may generate a less sharp sound compared to a typical non-division disk. Since the divided regions have different resonant frequencies, the frequency components of a sound may increase to three or more, and a smoother sound can be generated.

As described above, the audible frequency component ranges from about 20 Hz to about 20 kHz. Particularly, the most sensitive frequency component to human's ear ranges from about 2 kHz to about 5 kHz, and is thus sharply perceived by the human ear.

Typically, sounds may include various frequency components. When the frequency component from about 2 kHz to about 5 kHz is heard all by itself, the sound may be heard sharply and is thus painful to some people's ears. When, however, lower frequency components are mixed with the sharp frequency components, the sound may be heard less sharply.

Figure 4:
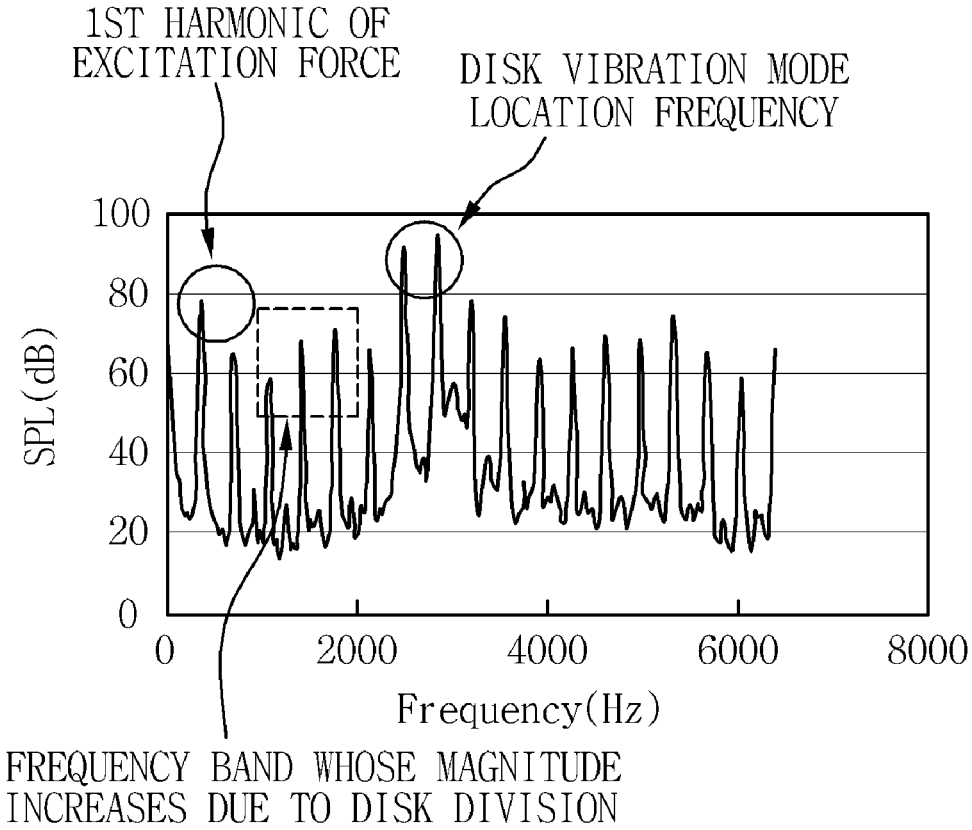
FIG. 4 is a view illustrating an oscillation frequency state of a disk.

A sound of a horn is mainly produced by the vibration of a disk. In this case, the sound may include frequency components of about 350 Hz (e.g., the 1st harmonic of an excitation force) and multiples thereof as shown in FIG. 4.

In a typical non-division disk structure, the high value may be shown at a band of about 3 kHz where the vibration mode of the disk is located. Accordingly, the sound may be heard sharply during vibration.

The frequency component of a sound may be substantially represented as 'excitation force frequency component multiplied by disk vibration frequency component'. The disk vibration frequency component may have a large value at the resonant frequency of the disk. Thus, the resonant frequency of the disk needs to be changed to modify the frequency component of the sound.

In a typical non-division disk structure, since a sound has a high value of about 3 kHz band, the sound needs to also have a high value of about 2 kHz or less band to be heard smoothly. For this, the resonant frequency of the disk needs to be also shown at 2 kHz or less. Accordingly, when the disk is divided to allow the resonant frequency to be additionally generated at 2 kHz or less, the sound may be boosted at 2 kHz or less to generate a smoother sound.

Figure 5:
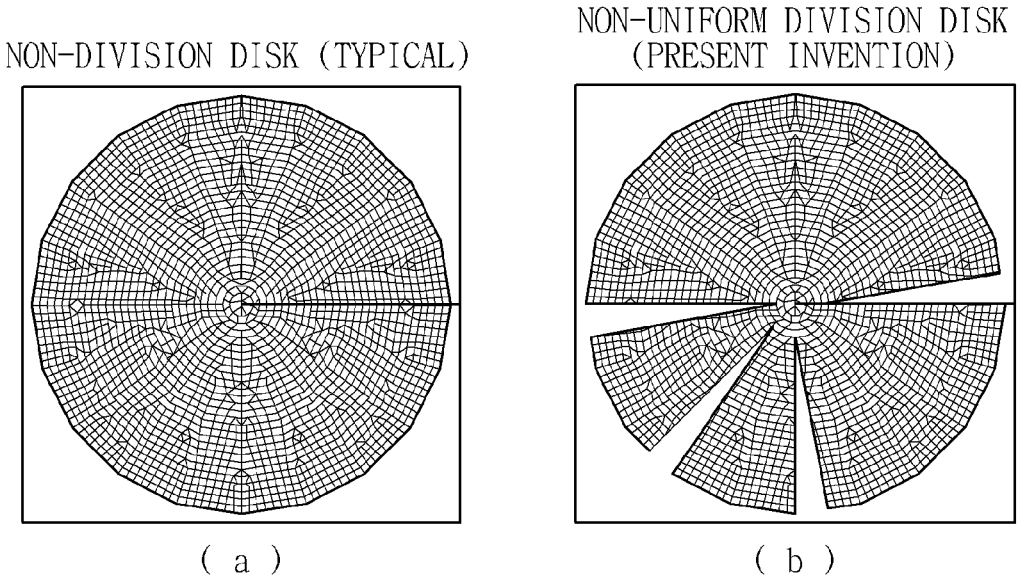
FIG. 5 is a view illustrating an exemplary vibration analysis model for a typical non-division disk and a non-uniform division disk according to an embodiment of the present invention.
Figure 6:
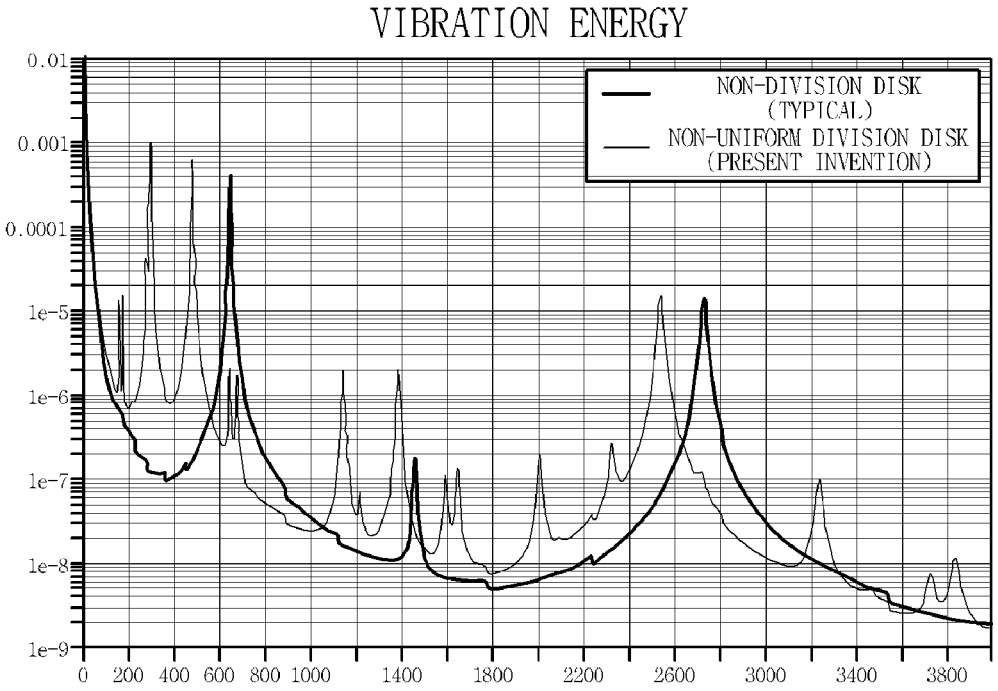
FIG. 6 is a graph illustrating vibration energy of a Z-direction when an excitation force is applied to each disk of FIG. 5.

FIG. 5 is a view illustrating an exemplary vibration analysis model for a typical non-division disk and a non-uniform division disk according to an embodiment of the present invention. FIG. 6 is a graph illustrating the sum of the vibration energy of a Z-direction (vertical direction of FIG. 3) when an excitation force is applied to the central point of each disk of FIG. 5

As shown in FIG. 6, there are two main peaks in a typical non-division disk, but there are five main peaks in a non-uniform division disk. It is estimated that the number of resonant frequencies reacting to Z-direction excitation in the non-uniform division disk is greater than that in the non-division disk.

As shown in Table 1, the actual number of the resonant frequencies of the disk is greater than that of the vibration peaks. However, the number of resonant frequencies reacting to the excitation force (i.e., the vertical direction) of the disk is two in the non-division disk, and five in the non-uniform division disk.

TABLE 1

| | Division | |
|---|---|---|
| | Non-division Disk (Typical) | Non-uniform Division Disk (Present Invention) |
| Number of vibration modes (4 kHz) | 22 ea | 31 ea |
| Number of vibration modes contributing to vibration when vertical excitation force is applied | 2 ea | 5 ea (based on main peak) |

Figure 7:
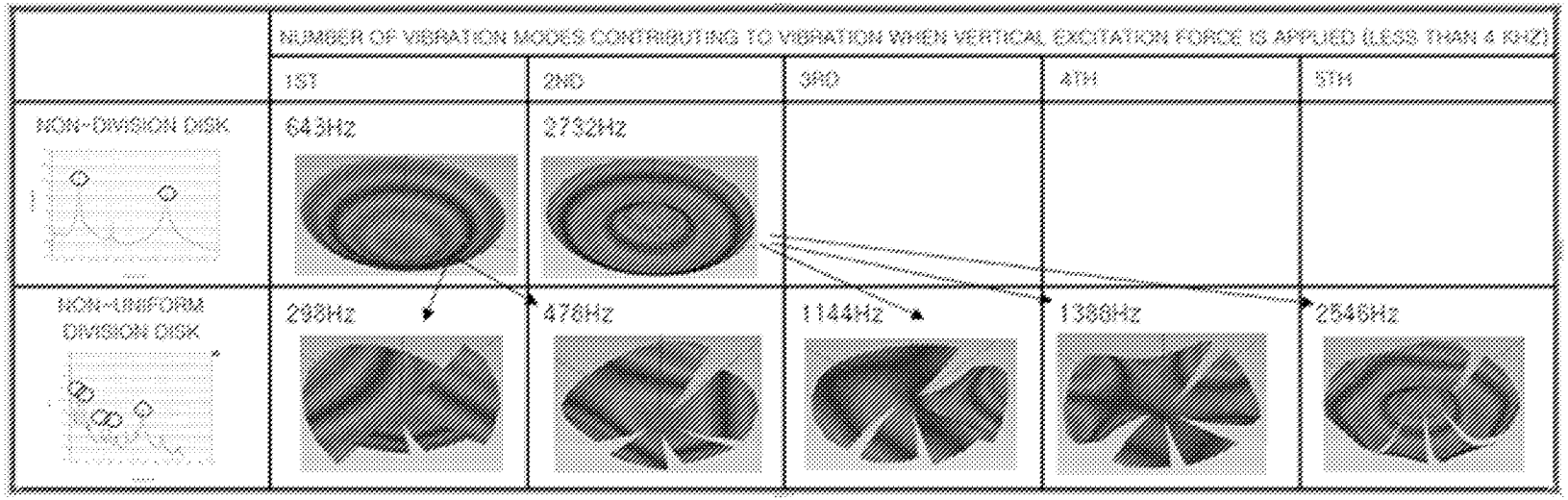
FIG. 7 is a view illustrating a main vibration mode of each disk shown in FIG. 5.

It can be seen that the main vibration modes of the non-division disk are divided into the modes of the non-uniform division disk. As shown in FIG. 7, the 1st main mode of the non-division disk is be divided into the 1st and 2nd main modes of the non-uniform division disk, and the 2nd main mode of the non-division disk is be divided into the 3rd, 4th, and 5th main modes. This is because the divided regions of the disk have different degrees of stiffness which is caused by the non-uniform division of the disk. Accordingly, the disk with a non-uniform division structure according to an embodiment of the present invention generates a sound of various frequency components and can therefore improve the sound in quality.

According to embodiments of the present invention, sounds having various frequency components can be generated by the non-uniform division structure of a disk. Also, since the disk has a plurality of resonant frequencies during vibration, the tone color and quality of the horn can be improved. In addition, when a disk of a horn for a vehicle according to an embodiment of the present invention is used, a single disk-type horn that can reduce the weight and cost and overcome limitations of typical multi-disk type horn and shell-type horns can be provided.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A disk for a horn of a vehicle, the disk comprising:

a shape in which a whole region of the disk is divided into a plurality of regions each having different vibration characteristics and a structure in which the plurality of regions are disposed along a circumferential direction of the disk; and a plurality of cut portions to form the plurality of regions each having a different vibration characteristic.

2. The disk of claim 1, wherein the plurality of regions have different areas that each have different vibration characteristics.

3. The disk of claim 1, wherein the whole region of the disk is divided into the plurality of regions via at least one cut portion longitudinally formed from an outer edge of the disk to a central portion of the disk.

4. The disk of claim 3, wherein the cut portions are longitudinally formed from the outer edge of the disk to the central portion of the disk along a radial direction of the disk.

5. The disk of claim 1 wherein the disk is formed in a petaloid shape that is divided into the plurality of regions with different vibration characteristics associated with each.

* * * * *